US010746362B1

(12) United States Patent
Salihovic

(10) Patent No.: US 10,746,362 B1
(45) Date of Patent: Aug. 18, 2020

(54) WALL WASH LUMINAIRE

(71) Applicant: HeathCo LLC, Bowling Green, KY (US)

(72) Inventor: Amer Salihovic, Bowling Green, KY (US)

(73) Assignee: HEATHCO LLC, Bowling Green, KY (US)

( * ) Notice: Subject to any disclaimer, the term of this patent is extended or adjusted under 35 U.S.C. 154(b) by 0 days.

(21) Appl. No.: 16/790,355

(22) Filed: Feb. 13, 2020

Related U.S. Application Data

(60) Provisional application No. 62/805,691, filed on Feb. 14, 2019.

(51) Int. Cl.

| | |
|---|---|
| ***F21S 8/00*** | (2006.01) |
| ***F21V 23/00*** | (2015.01) |
| ***F21V 23/04*** | (2006.01) |
| *F21Y 103/10* | (2016.01) |
| *F21Y 115/10* | (2016.01) |

(52) U.S. Cl.
CPC ..... *F21S 8/036* (2013.01); *F21V 23/003* (2013.01); *F21V 23/0464* (2013.01); *F21V 23/0471* (2013.01); *F21Y 2103/10* (2016.08); *F21Y 2115/10* (2016.08)

(58) Field of Classification Search
CPC .... F21S 8/036; F21V 23/003; F21V 23/0471; F21V 23/0464; F21V 21/02; F21V 21/10; F21V 21/108; F21V 23/008; F21Y 2115/10; F21Y 2103/10; F21W 2131/10; F21W 2131/107; F21W 2131/109
See application file for complete search history.

(56) References Cited

U.S. PATENT DOCUMENTS

| | | | | |
|---|---|---|---|---|
| 5,442,532 | A * | 8/1995 | Boulos | F21V 23/0442 362/276 |
| 6,781,129 | B2 * | 8/2004 | Leen | G08B 13/193 250/342 |
| 8,092,040 | B2 | 1/2012 | Wu et al. | |
| 8,348,489 | B2 | 1/2013 | Holman et al. | |
| 8,525,420 | B2 * | 9/2013 | Summerford | F21S 4/00 315/113 |
| 9,268,082 | B2 | 2/2016 | Petrus et al. | |
| 9,370,079 | B2 | 6/2016 | Aleksandrovna et al. | |

(Continued)

FOREIGN PATENT DOCUMENTS

| | | |
|---|---|---|
| CN | 201377734 Y | 1/2010 |
| CN | 205350972 U | 6/2016 |

OTHER PUBLICATIONS

Lighting Styles, Very Funky Filtered LED Wall Light, www.lightingstyles.co.uk, Retrieved from: https://www.lightingstyles.co.uk/very-funky-filtered-wall-lights-in-5-finishes, Retrieved on: Nov. 2, 2017.

(Continued)

*Primary Examiner* — Peggy A Neils
(74) *Attorney, Agent, or Firm* — Middleton Reutlinger

(57) ABSTRACT

An outdoor security light is provided which incorporates features of decorative luminaire illumination while also integrating security light functionality. Such features may include not only standard illumination, but also security light functionality such an ambient sensors, motion detection, while also providing an integrated luminaire having wall wash capabilities.

18 Claims, 6 Drawing Sheets

(56) References Cited

U.S. PATENT DOCUMENTS

| | | | | |
|---|---|---|---|---|
| 9,752,754 | B2 | 9/2017 | Trincia et al. | |
| 10,212,778 | B1 * | 2/2019 | Fu | G08B 3/00 |
| 2015/0219287 | A1 | 8/2015 | Wassel | |
| 2016/0025286 | A1 | 1/2016 | Wang et al. | |

OTHER PUBLICATIONS

Luminturs, Luminturs(TM) 10W Dimmable LED Waterproof Wall Sconces Exterier Up/Down Light Black finish Pure White, Retrieved from: https://www.amazon.com/LUMINTURS-Dimmable-Waterproof-Sconces-Exterior/dp/B01EUJE6A6/ref=sr_1_16?ie=UTF8&qid=1509631123&sr=8-16&keywords=up%2Fdown+light+sconce, Apr. 27, 2016, Retrieved on: Nov. 2, 2017.

* cited by examiner

WALL WASH LUMINAIRE

BACKGROUND

Outdoor security luminaires are commonly provided to emit light during predefined conditions including after detection of environmental circumstances such as sunrise, sunset and motion detection while also providing illumination around the location of the luminaire. Other illumination characteristics may be desirable which extend beyond the purely functional implementation of a security luminaire to areas such as decorative illumination. More particularly, decorative outdoor luminaires may include decorative illumination features in addition to standard security light functions providing such integrated functional aspects in a single decorative luminaire.

SUMMARY OF THE EMBODIMENTS

Multiple embodiments are provided in this disclosure setting forth aspects of a luminaire having a luminaire housing and a mounting base wherein the mounting base provides a wall wash effect along the mounting wall. The luminaire may include implementations of wall wash illumination emitted from the mounting base having both an upper and a lower wall wash output window. The mounting base may have at least a first and a second plurality of LEDs emitting light through the respective wall wash output windows, the plurality of LEDs being controlled by a luminaire controller and having power supplied by a power supply. The mounting base may also include a photo-optic sensor to detect ambient light as well as a switch operable to turn the wall wash LEDs on and off. The luminaire housing may contain a primary illumination source which is electrically connected to the power supply. The illumination source may be any type of illumination. For example, the illumination source may be incandescent, LED based or other types of illumination generally utilized within outdoor luminaires. The luminaire housing, supported by the mounting base via a support arm, may also have a sensor located thereon. For example, the sensor of the housing of the luminaire may be an ambient light sensor or a motion based sensor, such as a PIR (passive infrared).

The luminaire controller can control a characteristic of the illumination output of the LEDs acting as the wall wash sources and may also control the primary illumination source within the luminaire housing. Such control may optionally be based upon the input from the various sensors mounted on the mounting base, luminaire housing or mounting arm or from information received from an external source. For example, the luminaire controller can control the brightness, color temperature, intensity, or other alternative characteristic of the output light from the LEDs at either the wall wash plurality of LEDs or the primary illumination source.

Additionally or alternatively, the illumination controller may control aspects of the light output of the first plurality of LEDs, second plurality of LEDs and primary illumination source based upon the input of sensor information. For example, the first sensor may be an ambient light sensor indicating that the wall wash illumination emitted by the at least first and the second plurality of LEDs may be activated. As well, such control may or may not extend to the primary illumination source. Additionally or alternatively the primary illumination source may be controlled by a master electrical supply switch external to the luminaire or by a separate illumination controller. Further a primary switch on the mounting base may control the on/off status of the at least first and the second plurality of LEDs. Further control inputs for the illumination controller may for example include a second sensor or illumination control inputs from an external source such as an external sensor or a remote control user device. For example, a second sensor may be a motion type sensor which, when activated, may indicate to the illumination controller to turn on the primary illumination source and/or the wall wash illumination sources.

The above description is provided as an overview of some implementations disclosed herein. Additional description of these and other implementations is set forth in more detail herein.

In implementations, a luminaire having a wall wash capability is described. The luminaire includes a luminaire housing attached to a mounting base by a support arm and having a primary illumination source included within the housing along with a first sensor. A mounting base having a mounting base housing is also provided which is affixed to the support arm. The mounting base housing surrounding may include an illumination controller and a power supply electrically connected to the illumination controller. The illumination source in the luminaire housing is further electrically connected through the support arm to the power supply in the mounting base. The mounting base includes a first wall wash output window and a second wall wash output window wherein a first plurality of LEDs are in optical alignment with the first wall wash output window, and the second plurality of LEDs are in optical alignment with the second wall wash output window. The first wall wash output window is in a first optical direction while the second wall wash output window is in a second optical direction. The mounting base may also include switch and at least a second sensor, the controller receiving inputs from both the second sensor and the switch. The illumination controller is further operable to control the illumination characteristics of the illumination source of the luminaire housing, the first plurality of LEDs and the second plurality of LEDs.

These and other implementations of the technology described herein can include one or more of the following features.

In implementations, a luminaire is provided which may include a mounting base with a first wall wash output window and a second wall wash output window wherein the first wall wash output window is positioned in a first direction and the second wall wash output window is positioned in a second direction, the first direction different then the second direction. In other implementations, the first direction is opposite the second direction allowing first plurality of LEDs and the second plurality of LEDs to illuminate the wall or surface that the mounting base is mounted on in two opposing directions.

In other implementations, the luminaire having wall wash capabilities may include a first and a second sensor operably connected to the illumination controller. For example, the luminaire may have a first and a second sensor affixed either individually or in combination to or within one of either housing or support arm, or may be separated and placed on one of the individual structures set forth. For example, a sensor may be placed on, in or adjacent to the luminaire housing or affixed thereto. As well, for example, a sensor may be placed on, in or adjacent to the mounting base. As well, a sensor may be affixed within, on or to the support arm extending between the mounting base and the luminaire housing.

In some of these implementations, the first or second sensors may include an ambient light sensor or a motion sensor or other type of electronic sensor device. For example, an ambient light sensor may be a photodetector, photodiode or photonic integrated circuit, among various examples. As well, for example, the motion sensor may be a PIR (passive infrared), radar, ultrasonic, radio wave, video camera or other type of circuit or electronic device which detects motion.

In various aspects, the luminaire may include both a first and a second plurality of LEDs as the wall wash light source emitters. For example, a single or a plurality of LEDs may be combined to be the first and/or second plurality of LEDs which may be placed internally of the mounting base with an optional lens, light guides or reflectors to focalize or disperse the output wall wash illumination. As well, for example, one or both of the plurality of LEDs may be a linear strip of LEDs which are placed adjacent to an output window of the mounting base when in an implementation of situated within the base.

In other implementations and aspects, the luminaire may include light output windows along the various sides of the mounting base. For example, a separate window may be placed along each sidewall surface of the mounting base. Alternatively, the window may be a continuous window. For example, a light guide may be utilized to disperse light evenly through four light output zones along each of the four side walls of the mounting base, wherein the light is emitted from a single source or form a plurality of light sources.

In embodiments, both the first and the second plurality of LEDs may be controlled by the illumination controller. For example, the controller may be a pulse-width modulation (PWM) controller or other electrical circuit which may control the output characteristics of the plurality of LEDs. As well, for example, in implementations, the illumination controller may be operably to include appropriate drivers and control circuitry to control the output color, brightness (e.g. dimness) or other aspects of the LEDS. For example, the illumination controller may include appropriate LED driver software and hardware and the LEDs may be of optional output characteristics such as white or other primary colors, such as to effect RBG LED control.

In aspects, the mounting base may include a switch positioned on or near the mounting base which may be operably to modify the output of the first and the second plurality of LEDs. For example, a physical switch may be placed on the exterior of the mounting base to be physically accessible. In other implementations, the switch may be located internally and controlled by electronic communication, such as Wi-Fi, for control of the LEDs wherein an internal switch and or relay will control the illumination and or light output of the of the first and the second plurality of LEDs. For example, the switch may be operable to either extinguish or illuminate the LEDs.

In other embodiments, the illumination controller may modify the output of the illumination source based upon input from at least one of the first sensor or the second sensor. For example, the first sensor may be an motion sensor which allows the illumination source of the luminaire to activate upon sensing motion, e.g. a signal from the first sensor is send to the illumination controller indicating sensed motion and the illumination controller illuminates the illumination source. In additional implementations, the illumination controller may also concurrently illuminate the first and the second plurality of LEDs.

In implementations, the illumination source of the luminaire may be a standard incandescent bulb. Alternatively, the illumination source may be other types of light emitting device. For example, the illumination source may be an LED based illumination source and the illumination controller may be operably to appropriately control the illumination source and provide power thereto depending on the state of the sensors and power supply electrical feed signal. Such control, in implementations, may be implemented through a control line extending through the support arm.

In implementations, the disclosure includes a luminaire with wall wash mounting base having a mounting base having a mounting base housing, the mounting base housing having a support arm extending outward from the mounting base housing to support a luminaire housing; the luminaire housing supported by the mounting base housing and having an illumination source, the illumination source electrically connected to a power supply extending from the mounting base; the luminaire housing further having a motion sensor; the mounting base having an illumination controller, a first plurality of LEDs and a second plurality of LEDs, the illumination controller operable to control at least one illumination characteristic of the first plurality of LEDs and the second plurality of LEDs, the mounting base further having a second sensor in communication with the illumination controller; wherein the first sensor of the luminaire housing is a motion sensor and the second sensor of the mounting base is an optical sensor operable to sense the ambient light level; the first plurality of LEDs emitting light through a first wall wash window of the mounting base housing, the second plurality of LEDs emitting light through a second wall wash window of the mounting base housing; wherein the first plurality of LEDs emits light in at least a first direction and the second plurality of LEDs emits light in at least a second direction, the first direction substantially opposite the second direction.

In implementations, the described luminaire with wall wash features may also include a third and a fourth wall wash window, the mounting base housing being substantially rectangular and having four sides, each of the first, second, third and fourth wall wash window in a respective singular side of the mounting base housing.

In still further implementations, the wall wash luminaire may have a channel extending around the periphery underneath each of the first, second, third and fourth wall wash windows, the channel being a light guide.

Still further implementations of the disclosure include a luminaire with a wall wash mounting base having: a luminaire housing connected to a mounting base by a support arm, the luminaire housing containing an illumination source, the illumination source electrically connected to a power supply in the mounting base through the support arm; the mounting base having a luminaire controller, a first plurality of LEDs and a second plurality of LEDs, the first plurality of LEDs directing light in a first direction and the second plurality of LEDs directly light in a second direction, the first direction substantially opposite the second direction; both the first plurality of LEDs and the second plurality of LEDs electrically connected to the power supply and the luminaire controller; the luminaire controller controlling the light output of the first plurality of LEDs and the second plurality of LEDs; the mounting base also having an optical sensor for sensing an ambient light, the optical sensor providing an ambient light signal to the luminaire controller; the luminaire controller receiving a movement signal from a movement sensor on the luminaire housing; wherein the mounting base is affixable to a mounting wall and wherein the first plurality of LEDs provides a wall wash effect in the first direction and the second plurality of LEDs provides a wall wash effect in the second direction.

It should be appreciated that all combinations of the foregoing concepts and additional concepts described in further detail herein are contemplated as being part of the subject matter disclosed herein. For example, all combinations of claimed subject matter appearing at the end of this disclosure are contemplated as being part of the subject matter disclosed herein.

As used herein for purposes of the present disclosure, the term "LED" should be understood to include any electroluminescent diode or other type of carrier injection/junction-based system that is capable of generating radiation in response to an electric signal and/or acting as a photodiode. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" or "illumination source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "lighting fixture" or "security light" is used herein to refer to an implementation or arrangement of one or more lighting units in a particular form factor, assembly, or package. The term "security light" is used herein to refer to an apparatus including one or more light sources of same or different types. A given unit may have any one of a variety of mounting arrangements for the light source(s), enclosure/housing arrangements and shapes, and/or electrical and mechanical connection configurations. Additionally, a given unit optionally may be associated with (e.g., include, be coupled to and/or packaged together with) various other components (e.g., control circuitry) relating to the operation of the light source(s). An "LED-based security light" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

It should be appreciated that all combinations of the foregoing concepts and additional concepts described in greater detail herein are contemplated as being part of the subject matter disclosed herein. For example, all combinations of claimed subject matter appearing at the end of this disclosure are contemplated as being part of the subject matter disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the various embodiments.

DETAILED DESCRIPTION

Decorative outdoor lighting can include many features in order to improve the visual characteristics of the luminaire and illumination photometric performance. For example, many outdoor luminaires may include decorative housing structures to make the luminaire more appealing. Further, illumination output characteristics may be modified to adjust the performance of the photometric output while concurrently creating a pleasing illumination footprint. In one such example, wall wash luminaires can be provided which illuminates the vertical structure on which the luminaire is mounted. Such wall wash techniques and structures illuminate in a wide spread fashion such mounting surface.

The wall wash outdoor luminaire 100 described herein depicts a luminaire 30 affixed to a mounting base 50 and supported thereby via a support arm 40 or other structure. The luminaire may include multiple illumination sources in the various embodiments as well as a combination of sensors which may be positioned on any of the associated structural hardware of the luminaire 100 including the mounting base 50, support arm 40 or luminaire 30. In the various embodiments as well described and depicted in the figures and set forth within this specification, various types of illumination may be produced via known light production sources such as LED, incandescent, fluorescent, sodium or other high intensity discharge illumination, or any combination thereof.

Figure 1:
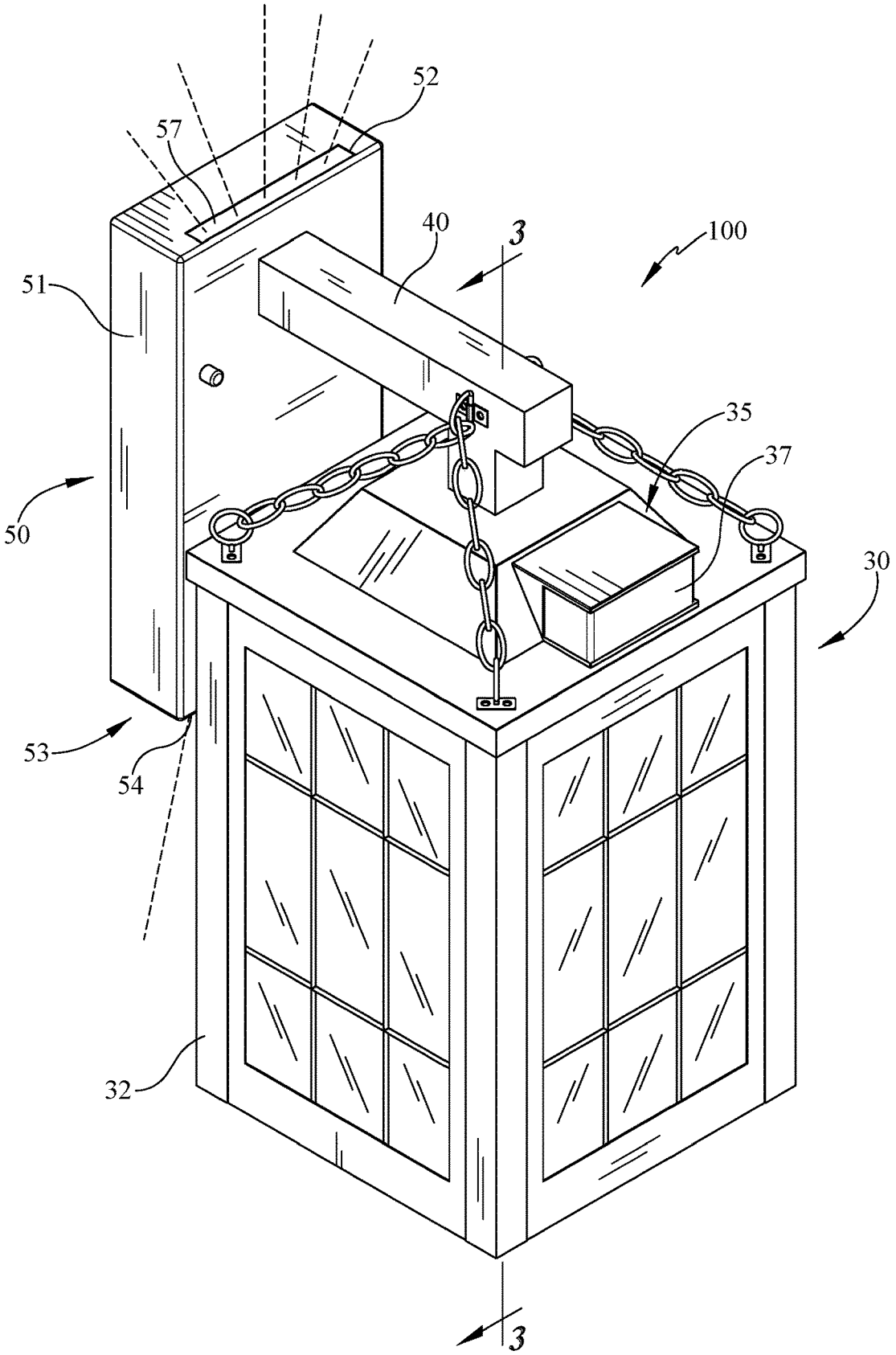
FIG. 1 illustrates an upper perspective view of the wall wash decorative luminaire described herein.
Figure 3:
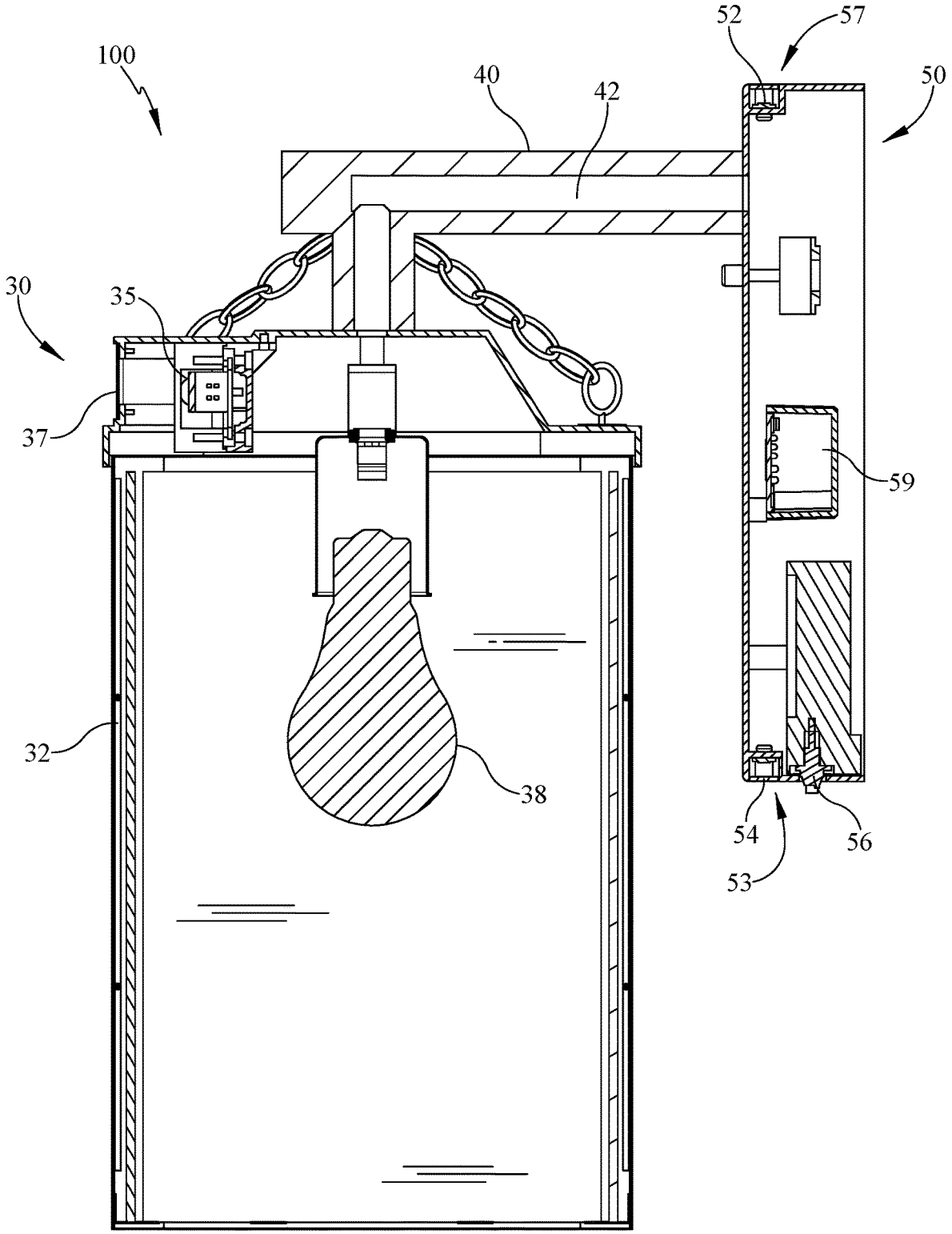
FIG. 3 illustrates a side sectional view of FIG. 1 taken along a sectional line and further described herein.

As depicted in FIG. 1, the wash decorative luminaire 100 includes the luminaire 30 which has a luminaire housing 32 and which has an illumination source 38, as depicted in FIG. 3. The luminaire 30 may have as well, in embodiments, a motion sensor 35 which sensor faces outwardly from the luminaire housing 32 in order to have a field of view which appropriately detects movement within a desired viewing range of, for example about 180 degrees or more. The sensor 35 is depicted, in the present embodiment towards the top surface of the luminaire housing 32 and may have an associated sensor window 37 or lens which may have a field of view of up to 270 degrees. The associated window 37 allows sensor 35 to detect motion in the field of view and send an appropriate motion detect signal to the illumination controller 59 depicted in FIG. 3.

For example, the sensor 35 may be a motion sensor such as a PIR which detects heat signatures over the field of view and which provides a DETECT signal to the appropriate illumination controller input pin and/or microprocessor 59 thereby indicating movement detection by the sensor.

In response to detected movement, the controller 59 may illuminate the illumination source 38 of the luminaire 30 for a predetermined period of time. Such time period may be set by the user through manual user input or may be set through a remote user device such as a smart phone connected through a local Wi-Fi network. For example, a switch or other manual input mechanism may be provided on the exterior surface of the mounting base 50 or may be positioned anywhere on the luminaire 100. In alternative embodiments, the controller 59 may include a Wi-Fi communication circuit to allow electronic communication and connection with the luminaire controller 59 and also have associated memory to store user defined operation details.

The sensor 35 may be any type of sensor to detect motion, such as a PIR, radar, ultrasonic, radio wave, video camera or other device which adequately indicates movement within a predetermined or modifiable field of view. Implementation of a motion sensor on the top outwardly facing location of the luminaire housing 32 may be beneficial to increase the detection window and field of view for movement detection. However other positions may also be chosen. For example, a movement sensor may be positioned along a lower edge of the luminaire housing 32, on the outer edge of the support arm 40 or also may be positioned nearby and send appropriate motion detect signals to the illumination controller 59 through a transmitted signal. In alternative embodiments, a remote sensor may be provided which signals movement to the luminaire.

Sensor 35 may also, in other various embodiments, be a combined sensor to detect more than one environmental condition or may, in the alternative, be an ambient light photo-detector to determine when the ambient light reaches a particular illumination level.

The illumination source 38, as shown in the embodiment of FIG. 3, may be an LED or incandescent light source or may be any other type of light source as needed. As shown in the figure, source 38 may be affixed to a traditional type 'A' socket and be electrically connected to a power supply within the mounting base through an electrical supply line extending through the support arm 40. The illumination source 38 may also be one or more LEDs appropriately controlled by the illumination controller 59 thereby making it easier to control output illumination characteristics of the light output. For example, the controller may control lamination intensity, color, or any other controllable characteristics. Also, the controller may modulate the light source by various modulation functionality.

Various other light modifying structures and or control surfaces may be provided in the luminaire housing 32 such as reflectors, light output windows and the like as is necessary to provide adequate control of the illumination characteristics of the luminaire 30.

Luminaire housing 32 may be supported by a support arm 40 as shown in the examples of FIG. 1. However, alternatively, the luminaire housing may also be directly affixed or unitary with the mounting base 50. For example, the luminaire may be removably attached to the mounting base along a slide rail type connection, may be affixed to the mounting base by a screw or other attachment mechanism or may be partially or fully integrated with the base housing 51. For example, the luminaire housing and the base may be made from a single structure or be integral with each other in a single luminaire.

Support arm 40 may include a supply channel or conduit 42 allowing electrical supply lines to extend from the power supply, illumination controller 59 and other electronics from the mounting base to the luminaire housing 32. For example, sensor 35 of the luminaire 30 may be connected by wire, in one embodiment, to the controller through the channel 42 of the support arm. As well, a power supply from the mounting base may be electrically connected to the illumination source 38 in the housing 32 via an electrical supply line extending through the interior of the support arm.

Figure 2:
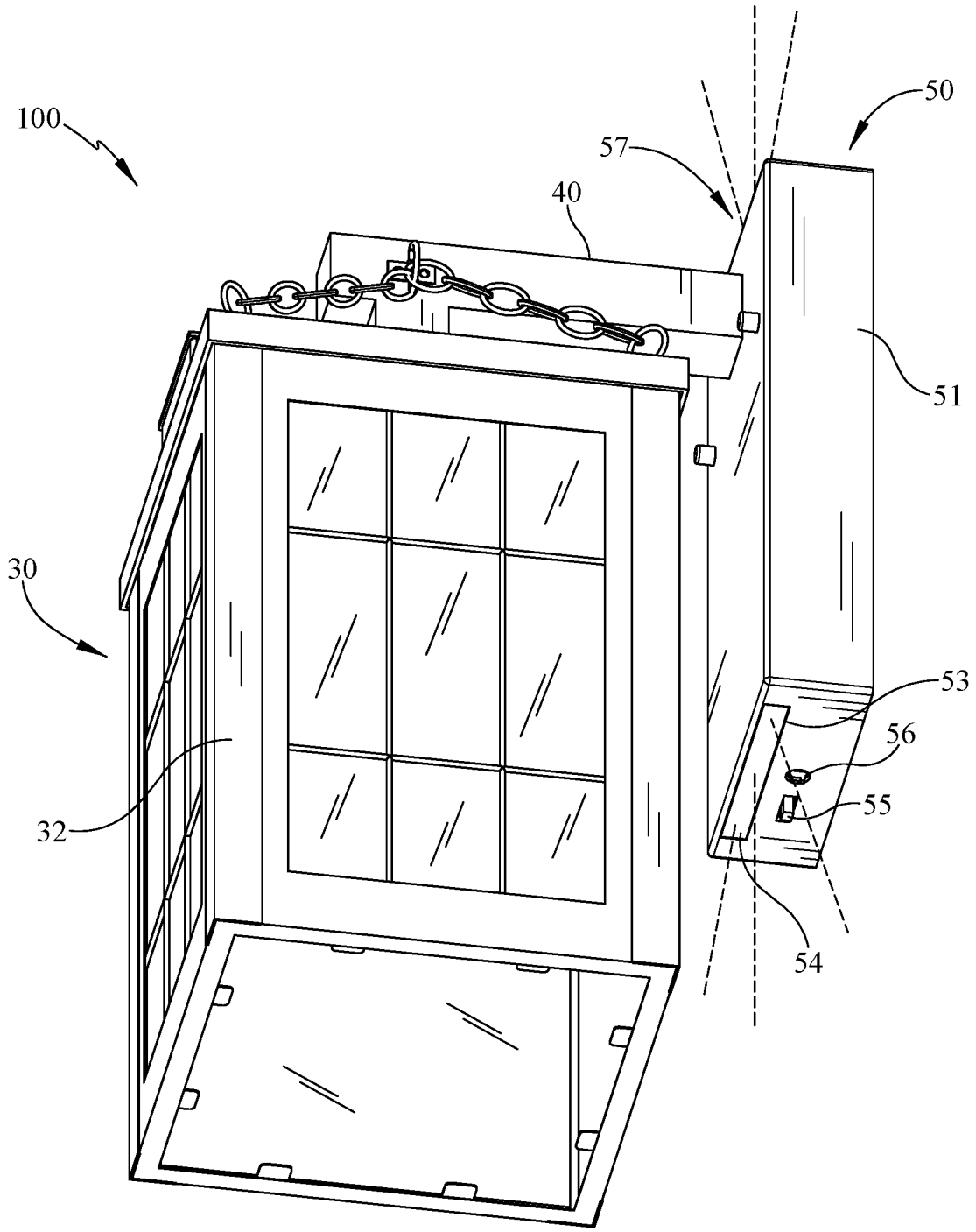
FIG. 2 illustrates a lower perspective view of the wall wash decorative luminaire described herein.

Mounting base 50 depicted in FIGS. 1, 2 and 3, may support the luminaire housing 32 via the support arm 40. Mounting base 50 may incorporate a housing 51 to contain various power supply, control and other necessary electronics For example, the housing 51 may contain at least the illumination controller 59.

Mounting base 50 may be mounted directly on a vertical surface in order to receive electrical power from a source, such a line voltage from a house. An associated junction box may allow wired connection of an electrical line from the mounting base and the base may be affixed to the junction box or other structure. Alternatively mounting base 50 may be affixed to a wall or other structure directly with electrical connection and include and/or incorporate a junction box directly in the structure of the base.

Mounting base 50 may also have at least an upper and a lower wall wash window 57, 53 respectively, allowing a strip of LED light output to function as wall wash illumination. A first plurality of LEDs 52 may be positioned in optical alignment with the upper window 57 while a second plurality of LEDs 54 may be positioned in optical alignment with the lower wall wash window 53 shown in FIGS. 2 and 3. The wall wash windows 57, 53 may incorporate lens structure or other light modifiers to control the output of the LEDs positioned within the housing. Alternatively, the LEDs 52, 54 may be positioned on an external surface allowing direct illumination of the surface without light modification from a window or lens structure of the mounting base. In other embodiments, a singular LED may be used with appropriate reflectors at both the upper and lower windows 57, 53.

The wall wash LEDs of the mounting base may be a linear strip of LEDs which are mounted in optical alignment with the wall wash windows. Alternatively, singular LEDs may be provided to function as the source of light for the wall wash feature. In other embodiments, four wall wash windows 57, 53, 61, 62 (FIG. 4) may be incorporated into the base to allow light output along any surface of the mounting base. Wall wash windows 57, 53, (and optionally 61, 62) may also incorporate optical adjustment mechanisms to appropriately modify the light output of the LEDs and focus their illumination into a wall wash photometric output. For example, at least one of the wall wash windows may utilize a lens or other device to narrowly focus, modify the output beam angle or width of the illumination along an optical path that would spread the light along a vertical wall surface along the mounting position of the wall mount base 50. Such light output modification devices could include lenses, as indicated, internal reflectors, light guides and/or individualized LED lenses. Of course, combinations of such structures may be utilized in order to properly focalize the light into a wall wash or other desired output configuration.

The linear strip or singular LEDs serving as the first and the second plurality of LEDs as well as, optionally, the third and fourth side emitting LEDs, may have light output which is controlled by the illumination controller 59. Illumination controller may control the output of the wall wash LEDs via pulse width modulation, direct current and or other known illumination control methods. The illumination controller 59 may receive power from the line voltage or other power supply internal to the mounting base such as rechargeable power source, and may also receive input from the various sensor or work in combination with an external input source to control the illumination characteristics and receive sensor input.

Figure 4:
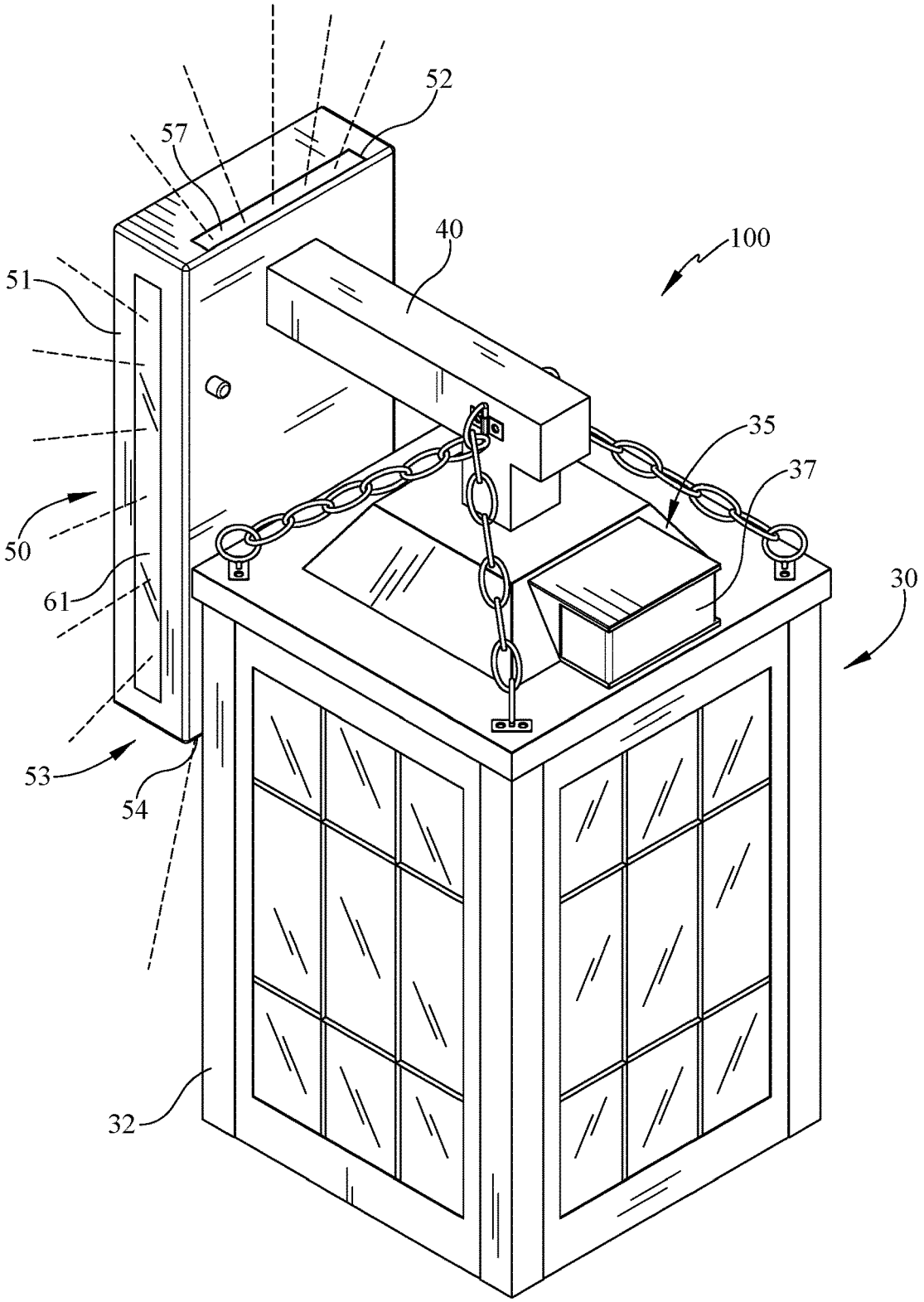
FIG. 4 illustrates a perspective view of another embodiment of the present disclosure.
Figure 5:
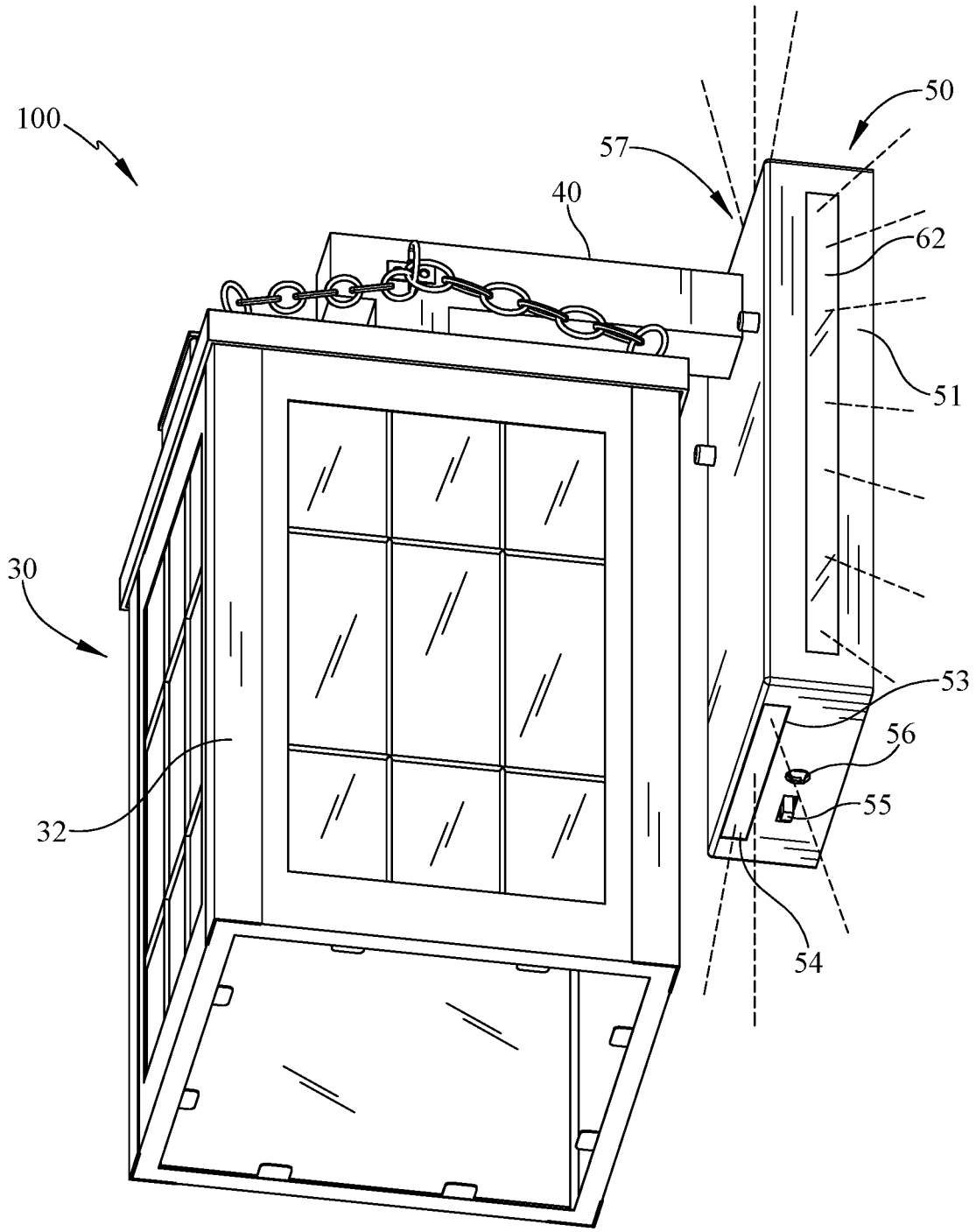
FIG. 5 illustrates a perspective view of an additional embodiment of the present disclosure.

Various alterations of the mounting base 50 may be incorporated to modify the wall wash effect. Additional wall wash windows may be provided to increase the amount of wall wash type light output that may be provided. For example, as depicted in FIGS. 4 and 5, a side emitting wall wash windows 61, 62 may be included within the base 50 structure, windows 61, 62 having a similarly aligned LED in optical alignment with the windows. The further wall wash window 62 as depicted in FIG. 5 may be provided on an alternative sidewall of the mounting base 50. Likewise, such window 62 may be in optical alignment with an LED or other illumination source as with the other LEDs of the base. In various implementations, windows 61, 62 may be provided concurrently with the windows 57, 53 or may be provided in place thereof. In some implementations, strips of LEDs may be placed directly adjacent and behind the windows 61, 62 as with windows 57, 53. Alternatively, in implementations for any of the windows, singular LEDs may be provided with light guides, pipes or with appropriate reflectors to evenly emit light through each of the appropriate windows.

For example, a single high output LED may be provided behind each individual window with a light guide allowing even light emission along the entire output surface of the respective window. Alternatively, in some implementations, a fiber optic light pipe may be provided either individually or around the perimeter of the base 50. In such implementations, a single source of light, such as a single high output LED or a plurality of positionally concentrated LEDs may be utilized wherein a light guide is used to direct light to each window along the perimeter of the base 50. For example, a light output source within the base maybe surrounded by fiber optics, light guide mediums, reflectors or other light redirection devices to channel the light to the light output zones on the exterior of the base 50.

Figure 6:
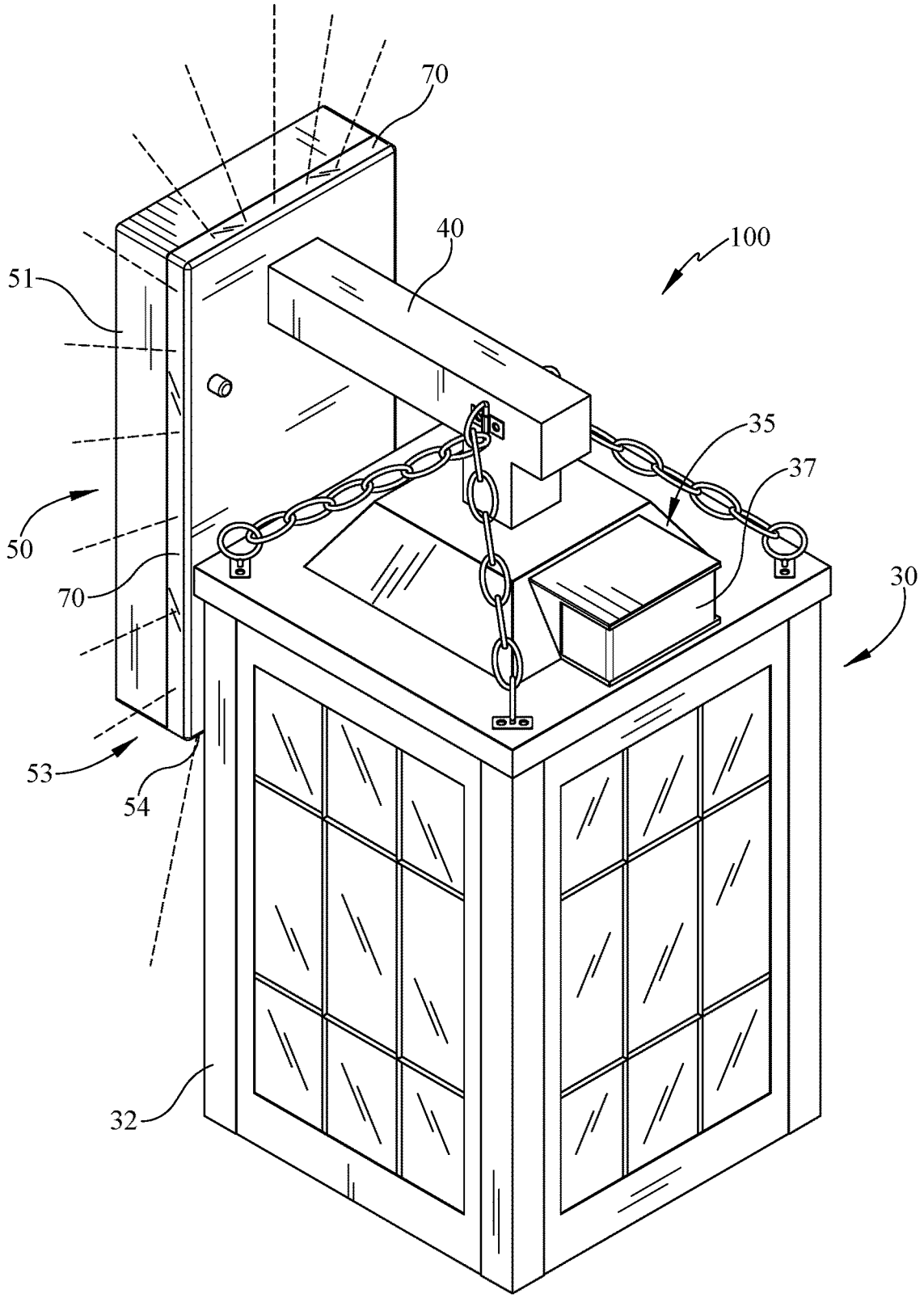
FIG. 6 illustrates a perspective view of an additional embodiment of the present disclosure.

Further embodiments are depicted in FIG. 6 wherein a light emitting channel 70 circumscribes the entirety of the mounting base 50. The light emitting channel 70 may act as a wall wash light emitting channel in 360 degrees around the mounting base 50 or at portions thereof. Various light emitting devices and/or engines may be utilized to provide even illumination and light output through the entirely of the channel. For example, light guides or other devices may be used to direct light extending around the periphery of the mounting base in alignment with the channel and may emit light evenly through the channel outlet or at desired locations. Further, light may be emitted at required light emission angles utilizing reflectors or other light modification techniques to provide appropriate wall wash effect at each of the sides of the base 50. For example, lenses or reflectors may be provided along the periphery within the channel to focalize the light rearward to the mounting and supporting surface. In other implementations, evenly spaced LEDs may be placed around the channel with appropriate lensing and reflectors to effectively and evenly emit wall wash light through the channel opening 70.

In implementations, the mounting base 50 may also include a sensor 56 and a switch 55 in order to further provide input and control to the illumination characteristics of the wall wash LEDs 52, 54 and the illumination source 38. For example, switch 55 may perform as an ON/OFF switch for the at least one wall wash feature while allowing the illumination source 38 to continue to operate. Alternatively the switch may be a 3-way rocker switch where a center position is OFF, a first rocker position is a primary source only, and a third position is all light sources ON; or any combination of control. Alternative switches may be provided, such as a wireless software switch, which may be connected from a remote location via Wi-Fi to the controller 59 or a push button switch or other manually operated indicator/modifier to control the output illumination of the wall wash LEDs 52, 54.

In addition, in various implementations the mounting base 50 may include a sensor 56 which provides signal input to the illumination controller 59. For example, sensor 56 may be an ambient light sensor such as a photocell or photo-diode which indicates the environmental ambient light level. Various other examples of circuits which convert ambient light into an electrical signal may be utilized. Alternatively, internal timers within the controller 59 may be utilized to compare current local time to known sunrise and sunset. For example, the controller may be operable to access local time signals via Wi-Fi, cellular, GPS, manual entry or other signals. Stored tables within memory associated with the controller maybe utilized which allows the controller to determine appropriate environmental ambient light allowing the luminaire to turn on the illumination source 38 and/or wall wash LEDs or lighting.

In options where an ambient light sensor it utilized, the output signal from the sensor 56 may feed directly into the illumination controller 59. For example, at dusk, the environmental sensor 56 may provide a signal to the controller 59 indicating that a threshold environmental lighting condition exists thereby allowing one or both the illumination source 38 and wall wash LEDs to be activated. Similarly, at dawn a similar signal may be provided to the controller 59 indicating that one or both of the illumination sources and wall wash LEDs 52, 54 need to be turned off.

The mounting base housing 51 may be made to be moisture resistant and prevent intrusion of water into the interior by utilizing gaskets and the like structures. Such moisture intrusion can occur through direct exposure to environmental conditions or through wicking of moisture from external sources. Various measures may be taken to prevent such intrusion into the housing structure 51. For example, sensors may include sealed washers or other flanges which prevent water intrusion. As well, support arm 40 may be connected utilizing known moisture isolation structure to prevent water from entering through the channel 42 and into the mounting base housing 51. For example, grommets and other rubber flanges may be used at connection points between the structures.

In operation, the luminaire 100 may receive electrical power via a junction box mounted in the wall to which the mounting box is affixed. An associated power supply line within the mounting base housing 51 may provide rectified or other power to the circuitry, LEDs, illumination sources based upon their power requirements. Relays and other internal circuit switches may allow the illumination controller 59 to turn on and turn off the various illumination sources as indicated or dictated by operator settings or default sensor settings.

Sensors 35 and 56 and switch 55 may provide signal input directly or indirectly to the controller 59 in order for illumination characteristics to be controlled and as well as the timing and overall operation of the illumination sources and luminaire.

In operation, at least the first LED 52 and second LED 54 may provide illumination above and below the mounting base 50 to provide a wall wash effect while in combination having a primary illumination source 38 of the luminaire housing 32. The wall wash output may be operationally controlled by the switches and controller and the output may be modified by the controller for user settings. The wall wash effect of the LEDs 52, 54 may be accomplished from windows 57, 53 positioned on the upper and lower surfaces of the mounting base housing 51, wherein the upper wall wash window 57 has a first light output direction and the lower wall wash window 53 has a second light output direction, the first light output direction being opposite to the second light output direction in order to provide both upper and lower wall wash characteristics.

The disclosed decorative outdoor luminaire provides an outdoor luminaire housing which provides standard illumination from the housing but which also provides a mounting base having both upper and lower directed wall wash capabilities in order to provide decorative wall wash capabilities.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A luminaire with wall wash mounting base, comprising:

a luminaire housing attached to a mounting base by a support arm, the luminaire including an illumination source and at least a first sensor;

the mounting base having a mounting base housing affixed to the support arm, the mounting base housing surrounding and including an illumination controller, and a power supply, the power supply electrically connected to the illumination controller;

the illumination source of the luminaire housing in electrical connection through the support arm to the power supply in the mounting base housing;

wherein the mounting base housing has a first wall wash output window and a second wall wash output window, the first wall wash output window in optical alignment with a first plurality of LEDs, the second wall wash output window in optical alignment with a second plurality of LEDs;

wherein the first wall wash output window is in a first optical direction, the second wall wash output window is in a second optical direction;

the mounting base housing of the luminaire having a switch and at least a second sensor, both the switch and the second sensor operably connected to the illumination controller;

the illumination controller operable to control an illumination characteristic of the illumination source of the luminaire housing, the first plurality of LEDs and the second plurality of LEDs.

2. The luminaire of claim 1 wherein the first wall wash output window is positioned in a first direction and the second wall wash output window is positioned in a second direction, the first direction different then the second direction.

3. The luminaire of claim 2 wherein the first direction is opposite the second direction allowing the first plurality of LEDs and the second plurality of LEDs to illuminate a surface the mounting base is mounted on in two opposing directions.

4. The luminaire of claim 1 wherein the first sensor is a motion sensor operably connected to the illumination controller.

5. The luminaire of claim 1 wherein the second sensor is an optical sensor to detect an ambient light around the luminaire.

6. The luminaire of claim 1 wherein the first plurality of LEDs are a linear strip of LEDs.

7. The luminaire of claim 6 wherein the second plurality of LEDs are a linear strip of LEDs.

8. The luminaire of claim 1 wherein the first and the second plurality of LEDs controlled by the illumination controller are dimmable.

9. The luminaire of claim 1 wherein the first and the second plurality of LEDs may be modified by the illumination controller to change color.

10. The luminaire of claim 1 wherein the switch on the mounting base housing is operable to modify the light output characteristics of the first plurality of LEDs and the second plurality of LEDs.

11. The luminaire of claim 10 where the switch is operable to one of extinguish or illuminate the first and the second plurality of LEDs.

12. The luminaire of claim 1 wherein the first sensor is a motion sensor, the second sensor is an optical sensor and wherein the illumination controller modifies the output of the illumination source based upon at least one of the first sensor and the second sensor.

13. The luminaire of claim 1 wherein the illumination source of the luminaire is at least one LED.

14. The luminaire of claim 1 wherein the illumination controller is operably connected to the illumination source and the first sensor through an electrical connection extending through the support arm.

15. A luminaire with wall wash mounting base, comprising:

a mounting base having a mounting base housing, the mounting base housing having a support arm extending outward from the mounting base housing to support a luminaire housing;

the luminaire housing supported by the mounting base housing and having an illumination source, the illumination source electrically connected to a power supply extending from the mounting base;

the luminaire housing further having a motion sensor;

the mounting base having an illumination controller, a first plurality of LEDs and a second plurality of LEDs, the illumination controller operable to control at least one illumination characteristic of the first plurality of LEDs and the second plurality of LEDs, the mounting base further having a second sensor in communication with the illumination controller;

wherein the first sensor of the luminaire housing is a motion sensor and the second sensor of the mounting base is an optical sensor operable to sense the ambient light level;

the first plurality of LEDs emitting light through a first wall wash window of the mounting base housing, the second plurality of LEDs emitting light through a second wall wash window of the mounting base housing;

wherein the first plurality of LEDs emits light in at least a first direction and the second plurality of LEDs emits light in at least a second direction, the first direction substantially opposite the second direction.

16. The luminaire of claim 15 further including a third and a fourth wall wash window, the mounting base housing being substantially rectangular and having four sides, each of the first, second, third and fourth wall wash window in a respective singular side of the mounting base housing.

17. The luminaire of claim 16 wherein the mounting base housing has a channel extending around the periphery underneath each of the first, second, third and fourth wall wash windows, the channel being a light guide.

18. A luminaire with a wall wash mounting base, comprising:

a luminaire housing connected to a mounting base by a support arm, the luminaire housing containing an illumination source, the illumination source electrically connected to a power supply in the mounting base through the support arm;

the mounting base having a luminaire controller, a first plurality of LEDs and a second plurality of LEDs, the first plurality of LEDs directing light in a first direction and the second plurality of LEDs directly light in a second direction, the first direction substantially opposite the second direction;

both the first plurality of LEDs and the second plurality of LEDs electrically connected to the power supply and the luminaire controller;

the luminaire controller controlling the light output of the first plurality of LEDs and the second plurality of LEDs;

the mounting base also having an optical sensor for sensing an ambient light, the optical sensor providing an ambient light signal to the luminaire controller;

the luminaire controller receiving a movement signal from a movement sensor on the luminaire housing;

wherein the mounting base is affixable to a mounting wall and wherein the first plurality of LEDs provides a wall wash effect in the first direction and the second plurality of LEDs provides a wall wash effect in the second direction.

* * * * *